US005546858A

United States Patent [19]

Stephan

[11] Patent Number: 5,546,858

[45] Date of Patent: Aug. 20, 1996

[54] PRINTING PRESS

[75] Inventor: Günter Stephan, Bensheim, Germany

[73] Assignee: Heidelberger Druckmaschinen Aktiengesellschaft, Heidelberg, Germany

[21] Appl. No.: 407,978

[22] Filed: Mar. 22, 1995

[30] Foreign Application Priority Data

Mar. 24, 1994 [DE] Germany ..... 44 10 189.9

[51] Int. Cl.[6] ..... B41F 7/06; B41F 1/32

[52] U.S. Cl. ..... 101/142; 101/232

[58] Field of Search ..... 101/232, 424.1, 101/228, 216, 231, 233, 174, 175, 136, 137, 142; 271/90, 276, 195, 194; 34/359, 360, 361, 362, 364, 366, 369

[56] References Cited

U.S. PATENT DOCUMENTS 4,384,524 5/1983 Simeth et al. .
5,086,698 2/1992 Wirz .
5,156,090 10/1992 Wirz ..... 101/142
5,398,925 3/1995 Zelter ..... 271/276

FOREIGN PATENT DOCUMENTS 0246100 11/1987 European Pat. Off. .
3044649 6/1982 Germany .
3536536 6/1986 Germany .
3622515 2/1987 Germany .
3920730 1/1991 Germany .
4039311 6/1992 Germany .
4217813 12/1993 Germany .

*Primary Examiner*—J. Reed Fisher
*Attorney, Agent, or Firm*—Nils H. Ljungman and Associates

[57] ABSTRACT

A guide device for moving sheet material in printing presses, which by means of blown air, presses the sheet material flat against the cylindrical surface of a transporting drum or a cylinder, essentially without any contact between the sheet material and the guide device. The guide device can have a guide plate which generates a stream of blown air in the direction opposite to the direction of travel of the moving sheet material.

18 Claims, 5 Drawing Sheets

PRINTING PRESS

BACKGROUND OF THE INVENTION

1. Field of the Invention

The present invention generally relates to a guide device for moving sheet material in printing presses, which guide device, by means of blown air, presses the sheet material flat or smoothly against the shell of a transporting drum or of a cylinder, essentially without any contact between the sheet material and the guide device.

2. Background Information

A similar device is disclosed in German Patent No. 30 44 649 C2 which corresponds to U.S. Pat. No. 4,384,524, wherein a smoothing or blowing device with a blast chamber for applying or pressing a sheet against a printing cylinder or a sheet transfer drum uses blown air to press sheets against the external surface of rotating cylinders or sheet transfer drums. The blowing device extends over the width of the printing press and is located at a defined distance from the cylindrical surface of the printing cylinder or of the sheet transfer drum. The application thereby achieved is effective essentially only to a limited extent, and can become altogether ineffective as soon as the end of the sheet moves away from the vicinity of the blast chamber.

An additional device which is used to press the sheet flat is disclosed in German Patent No. 39 20 730 C2, which corresponds to U.S. Pat. No. 5,086,698. This device uses a blast nozzle which directs a current of air onto the sheet material, thereby achieving a brushing or flattening effect. Here again, it is essentially impossible to reliably prevent a relaxation of the sheet material and thus uneven contact with the cylinder, in particular when thin sheet material is used.

OBJECT OF THE INVENTION

The object of the present invention is therefore to achieve a smooth guidance and tight application of the sheet material, e.g. against the printing cylinder or sheet transfer drum.

SUMMARY OF THE INVENTION

The present invention teaches that this object can be achieved by means of a guide device, which guide device preferably has a guide plate which matches, or is adapted to, the corresponding cylindrical surface of the printing cylinder. The guide plate can preferably be connected to a blast air chamber, and the guide plate can have blast openings which generate an air current in a direction essentially opposite to the direction of travel of the moving sheet material. By using a guide device in accordance with the present invention, it is possible to correctly guide the sheet to be transported until it is essentially immediately in front of the inlet gap for the next cylinder. The guide device can essentially guarantee that the sheet will not lift up or be wrinkled or folded, even when thick sheet material is used. Contact between the sheet material and the guide device can also be prevented, as is premature contact with the next cylinder, so that, for example, damage to the image printed on the sheet material can preferably be prevented.

As a result of the smooth application of the sheet material against the cylinder in accordance with the present invention, it can also be possible to take measurements of the print quality on the moving sheet.

In accordance with one advantageous embodiment of the present invention, the blast openings in the guide plate can preferably be oriented diagonally, and can also be directed opposite to the direction of travel of the sheet material, to prevent the sheet material from lifting away from the surface of the cylinder. It thereby becomes possible, as a result of the movement and speed of the sheet material being transported, to preferably disrupt or destroy the dragged or moving boundary layer on the surface of the sheet, and thereby to prevent the sheet from lifting up by means of the resulting suction action.

In accordance with an additional advantageous embodiment of the present invention, the holes in the peripheral area of the guide plate, preferably viewed at right angles to the direction of travel, can preferably be directed essentially opposite to the direction of travel and can also be directed inwardly, to prevent the blown air from escaping laterally. It can also be advantageous if essentially all the holes in the guide plate are directed opposite to the direction of travel and inwardly.

To achieve an economical consumption of blown air, it is advantageous if the guide device, viewed essentially over the length of the drum or of the cylinder, preferably covers only a portion of the shell-like surface of the cylinder.

The above discussed embodiments of the present invention will be described further hereinbelow with reference to the accompanying figures. When the word "invention" is used in this specification, the word "invention" includes "inventions", that is, the plural of "invention". By stating "invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

One aspect of the invention resides broadly in a printing press comprising a frame; a plate cylinder rotatably mounted on the frame, the plate cylinder for positioning a printing plate thereon; an ink reservoir for holding a supply of ink; an inking mechanism for transferring the ink between the ink reservoir and the plate cylinder during operation of the printing press; the inking mechanism comprising a plurality of inking rollers for transferring ink from the ink reservoir to the plate cylinder; a blanket cylinder being rotatably mounted on the frame and having means for being engaged with the plate cylinder during operation of the printing press, sheet feeding means for feeding sheets of printing stock into the printing press; at least one sheet transfer cylinder for receiving sheets being fed, and transferring sheets through, the printing press, the at least one sheet transfer cylinder having an outer surface disposed thereon; printing cylinder means for advancing sheets of printing stock towards the blanket cylinder to be printed, the printing cylinder means having an outer surface disposed thereon; means for guiding sheets of printing stock along the outer surface of at least one of: the printing cylinder means and the at least one sheet transfer cylinder; the guiding means being disposed adjacent the at least one of: the printing cylinder means and the at least one transfer cylinder; the guiding means comprising: a guide plate being disposed substantially along at least a portion of the outer surface of the at least one of: the printing cylinder means and the at least one transfer cylinder; and the guide plate comprising a contoured shape, the contoured shape substantially corresponding to the outer surface of the at least one of: the printing cylinder means and the at least one transfer cylinder.

Another aspect of the invention resides broadly in a printing press comprising: a frame; a plate cylinder rotatably mounted on the frame, the plate cylinder for positioning a printing plate thereon; an ink reservoir for holding a supply of ink; an inking mechanism for transferring the ink between the ink reservoir and the plate cylinder during operation of the printing press; the inking mechanism comprising a plurality of inking rollers for transferring ink from the ink reservoir to the plate cylinder; a blanket cylinder being rotatably mounted on the frame and having means for being engaged with the plate cylinder during operation of the printing press; sheet feeding means for feeding sheets of printing stock into the printing press; at least one sheet transfer cylinder for receiving sheets being fed and transferring sheets through the printing press, the at least one sheet transfer cylinder having an outer surface disposed thereon; printing cylinder means for advancing sheets of printing stock towards the blanket cylinder to be printed, the printing cylinder means having an outer surface disposed thereon; means for guiding sheets of printing stock along the outer surface of at least one of: the printing cylinder means and the at least one sheet transfer cylinder; the guiding means being disposed adjacent the at least one of: the printing cylinder means and the at least one transfer cylinder; the guiding means comprising: chamber means for receiving and holding pressurized air received from an air source; a guide plate disposed substantially along at least a portion of the outer surface of the at least one of: the printing cylinder means and the at least one transfer cylinder; the guide plate being disposed adjacent the chamber means; the guide plate comprising means for directing a flow of air from the chamber means towards the printing stock; and the chamber means being the sole chamber means for providing pressurized air to the means for directing.

BRIEF DESCRIPTION OF THE DRAWINGS

The present invention is illustrated in the accompanying drawings, in which.

DESCRIPTION OF THE PREFERRED EMBODIMENT

Figure 1A:
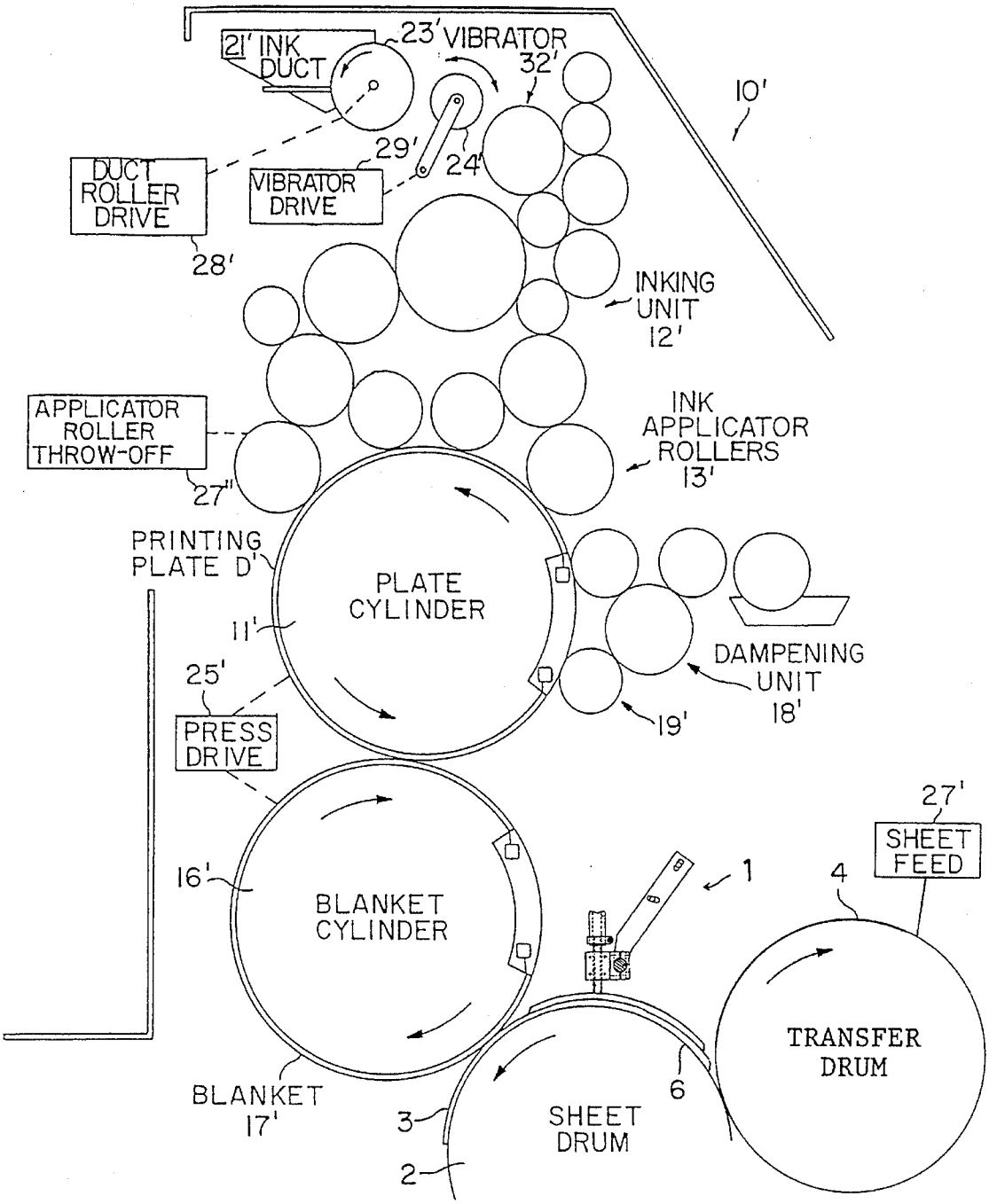
FIG. 1*a* shows a printing unit of a printing press incorporating the guide device of the present invention.

FIG. 1*a* illustrates a rotary print stand 10' of a rotary printing press which can employ a guide device 1 according to the present invention, which guide device 1 is discussed in further detail herebelow. Rotary print stand 10' generally includes: a plate cylinder 11' for having mounted thereon a printing plate D'; an inking unit 12' which includes ink applicator rollers 13' for applying ink to the printing plate D'; a dampening (or wetting) unit 18' having dampening applicator rollers 19' for transferring a dampening agent to the printing plate D', a blanket cylinder 5 carrying a rubber blanket 17' for receiving an ink impression from the printing plate D', and a printing cylinder or sheet drum 2 for carrying a printed sheet 3, onto which sheet 3 the ink impression carried by blanket 17' is transferred. The printing cylinder or sheet drum 2 preferably picks up the sheet material 3 from a transfer drum 4 and carries the sheet 3 about an outer surface 6 thereof. A sheet feed 27' (shown schematically only) can preferably supply the sheets to be printed to transfer drum 4.

Further, a duct roller 23' is typically mounted adjacent to an ink duct 21'. Typically, ink is transferred from duct roller 23' to inking unit 12' by means of a vibrator roller 24' which oscillates to successively pick up ink from duct roller 23' and deposit the same on a roller 32' of inking unit 12'. In addition, the printing stand 10' can also include auxiliary mechanisms such as, for example, a duct roller drive 28', a vibrator roller drive 29', an applicator roller throw-off 27" for lifting the ink applicator rollers 13' off of the printing plate D', end a press drive 25'.

It should be understood that the components and methods discussed above with relation to FIG. 1*a* may, if appropriate, essentially be considered to be interchangeable with similar components and methods discussed further herebelow with relation to FIGS. 1*b*–4*a*.

Figure 1B:
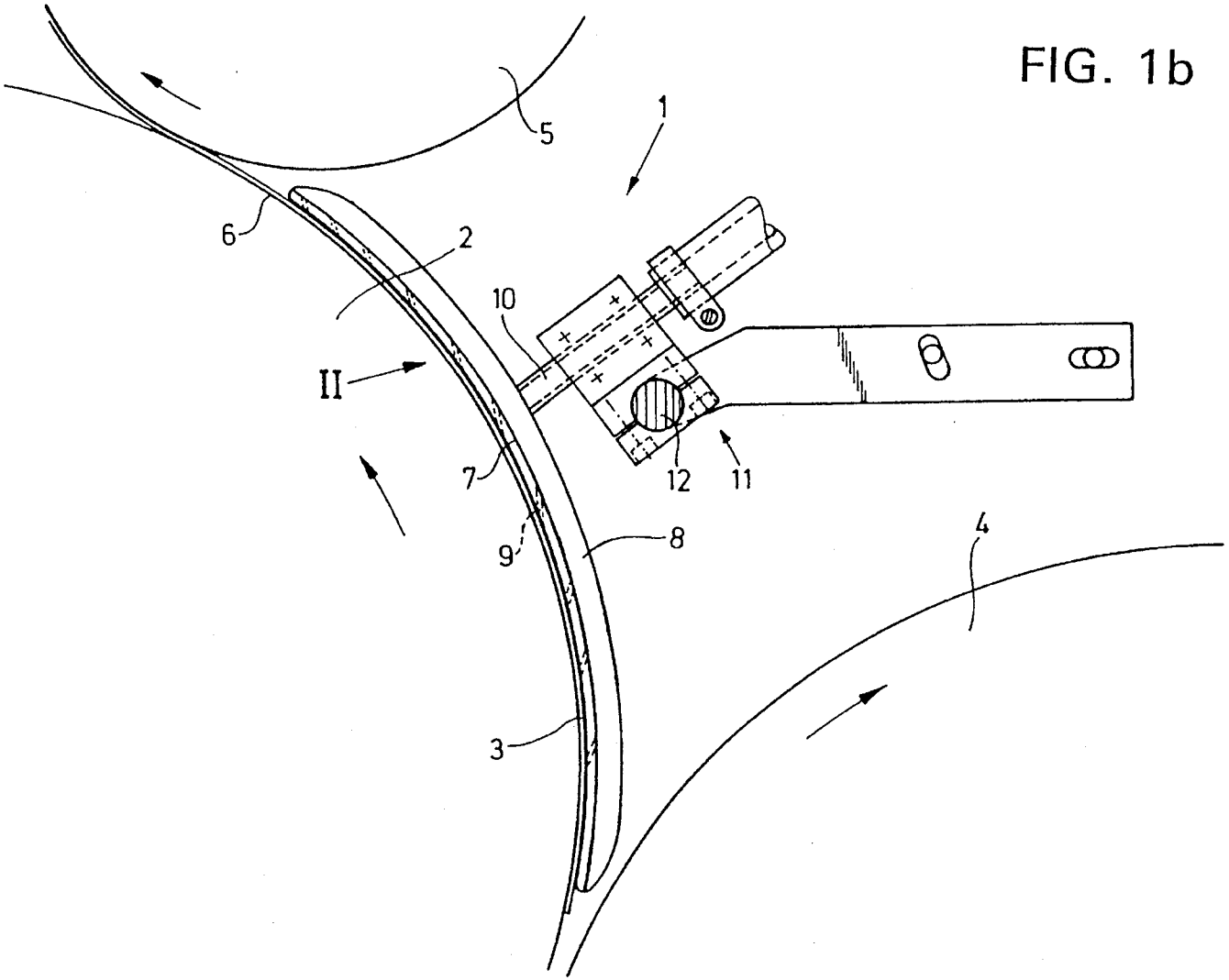
FIG. 1*b* shows a side view of the guide device.
Figure 1C:
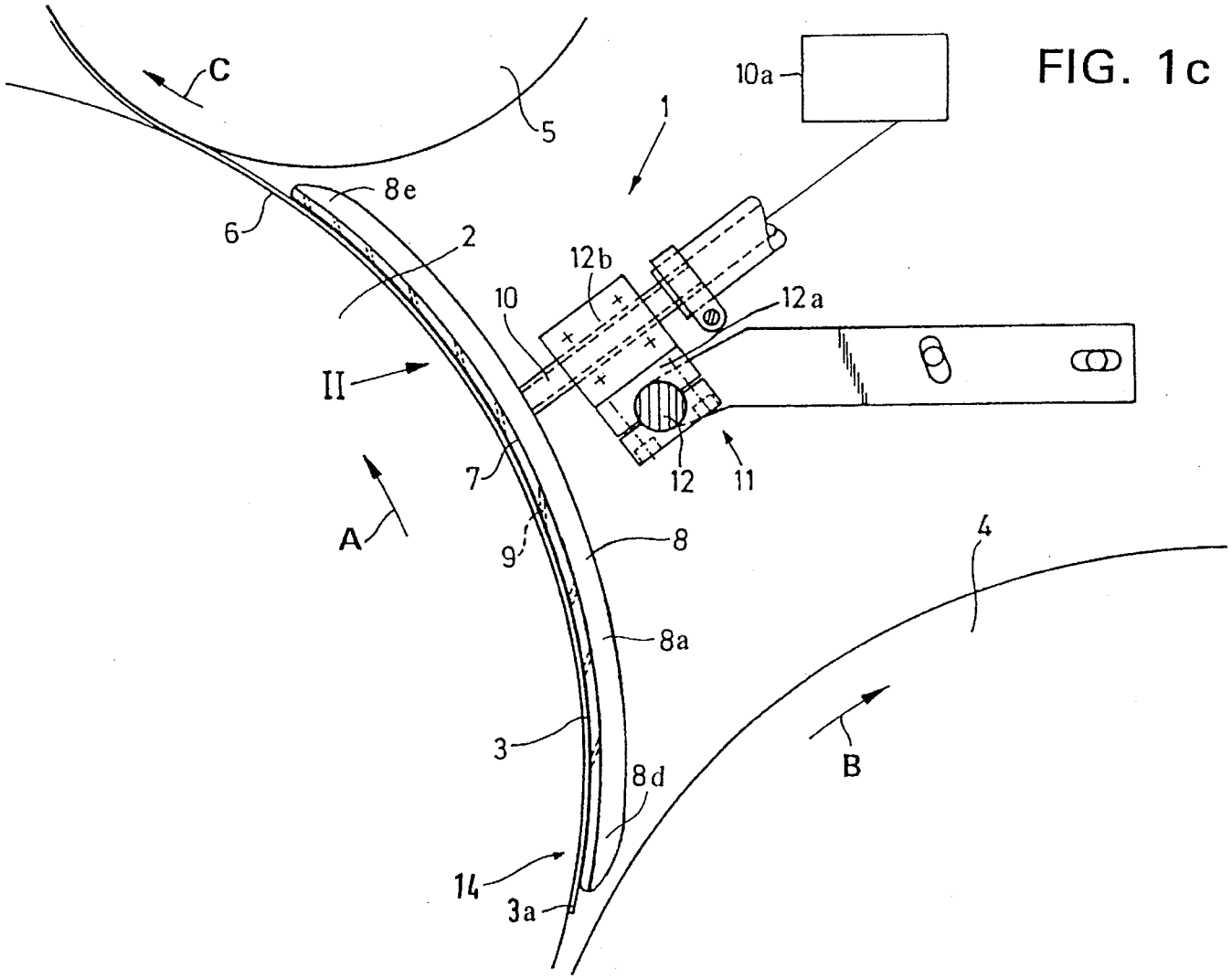
FIG. 1*c* shows substantially the same view as FIG. 1*b*, but shows additional components.

FIGS. 1*b* and 1*c* show the guide device 1, which guide device 1 can preferably correspond, in a printing press, to the printing cylinder 2. This printing cylinder 2 preferably picks up, from the transfer drum 4, the sheet material 3 being transported and transports the sheet material 3 to or towards a rubber blanket cylinder 5. The directions of rotation of the printing cylinder 2, the transfer drum 4, and the blanket cylinder 5 are indicated by the arrows A, B, and C, respectively, as shown in FIG. 1*c*. In accordance with one embodiment, the guide device 1 can preferably be located essentially directly adjacent the outside cylindrical surface 6 of the printing cylinder 2, and the sheet material 3 being transported can preferably lie on the outside surface 6 of the printing cylinder 2.

The guide device 1 can preferably include a guide plate 7 which essentially matches, or is adapted to the contour of the outer surface 6 of the printing cylinder 2. The guide plate 7 can preferably be connected to a blast chamber 8, which blast chamber 8 can have openings 9 for blown air, which openings 9 can, in turn, generate an air flow in a direction essentially opposite to the direction of travel of the sheet material 3. In accordance with one embodiment of the present invention, the direction of travel of the sheet material 3 on the printing cylinder 2 can also be considered to be represented by arrow A (see FIG. 1*c*). The blast chamber 8 can preferably be fastened to a tube 10, through which tube 10 the blown air can be transported. In accordance with one embodiment, a pressurized air source 10*a* (shown schematically only in FIG. 1*c*), or possibly a fan blower, can preferably provide air to tube 10. The tube 10 can preferably be mounted on a bracket 11, and the bracket 11 can, in turn, be fastened to the side frame of the machine or print stand 10' (see FIG. 1*a*). By means of the bracket 11, the blast chamber 8 and thus the guide plate 7 can be adjusted in relation to the printing cylinder 2, and, if necessary, can also be displaced laterally with respect to the printing cylinder 2. This adjustment can preferably be made by means of a spindle 12, which spindle 12 can essentially extend over the width of the printing cylinder 2.

In accordance with one preferred embodiment of the present invention, the spindle 12 can preferably permit the tube 10 and the guide plate 7 to be pivotably movable with respect to the bracket 11. Disposed about the spindle 12 there can preferably be a clasp member 12*a*, which clasp member 12*a* can be clamped about the spindle 12 to affix guide plate 7 and blast chamber 8 in a fixed position relative to the cylinder 2. A similar clasp 12*b* can be disposed about the tube 10 to affix the tube to the bracket 11. Thus, the guide plate 7 can preferably be adjusted with respect to the outer surface 6 of the printing cylinder 2 in essentially every direction.

Further, and in accordance with a preferred embodiment of the present invention, the blast chamber 8 can preferably extend continuously along a side 7*c* (see FIG. 4*a*) of guide plate 7. The blast chamber 8 can preferably be defined by side 7*c* of guide plate 7, two side walls 8*a*, 8*b*, and a bottom part 8*c*. Thus, the blast openings 9 can preferably receive air from a common chamber, i.e. blast chamber 8. Blast chamber 8 can also be considered to be an accumulation chamber for accumulating air received through the tube 10 from the air source 10*a*, which air is then directed out of the guide plate 7 through the openings 9.

As shown in FIGS. 2 to 4*a*, the blast openings 9 in the guide plate 7 can preferably be oriented at an angle, essentially opposite to the direction of travel A of the sheet material 3, in order to prevent the sheet material 3 from lifting up off of the shell surface 6 of the printing cylinder 2. In other words, and in accordance with one embodiment, the blast openings 9 can preferably be disposed at an angle (alpha) with respect to a tangent to surface 6 and/or sheet 3. Further, this angle (alpha) can preferably be about 30° (see FIG. 3*a*).

It can also be particularly advantageous if the blast openings 9 in the guide plate 7, in a peripheral area 13 of the guide plate 7 and viewed at right angles to the direction of travel, are directed essentially opposite to the direction of travel A of the sheet material 3 and inwardly, preferably to prevent a lateral escape of the blown air.

Figure 2A:
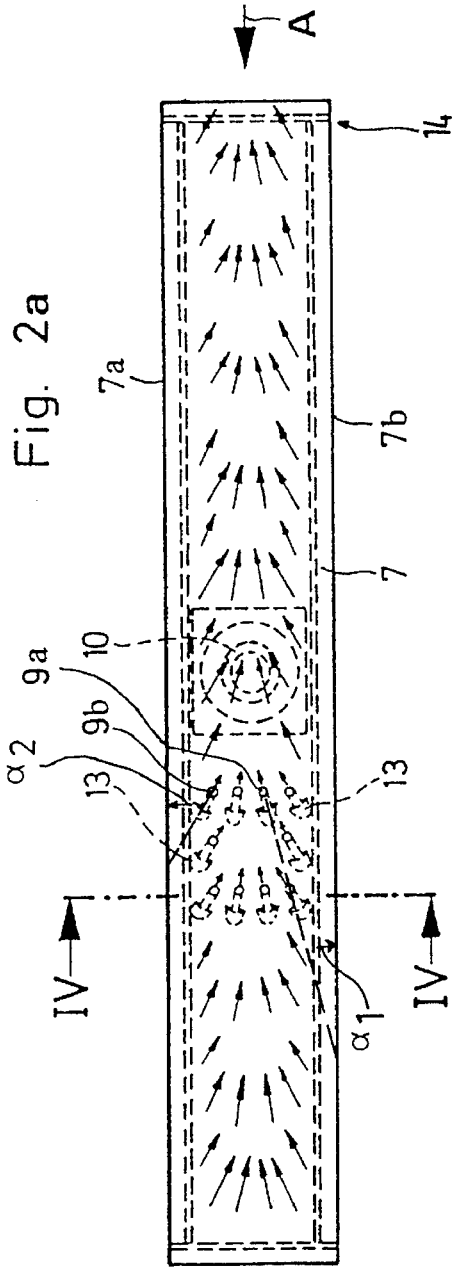
FIG. 2*a* shows substantially the same view as FIG. 2, but shows additional components.

For example, and in accordance with one embodiment of the present invention shown in FIG. 2*a*, there can preferably be a number of blast openings 9 located centrally between two edges 7*a*, 7*b* of guide plate 7. These central blast openings, one of which is designated 9*a*, can preferably be oriented at a slight angle ($alpha_1$) with respect to edges 7*a*, 7*b*. This angle ($alpha_1$) can preferably have a value of about 15°. Further, there can preferably be a number of peripheral blast openings, one of which is designated 9*b*, located adjacent peripheral area 13 of the guide plate 7. These peripheral blast openings 9*b* can preferably be oriented at a larger angle ($alpha_2$) with respect to edges 7*a*, 7*b*. This angle ($alpha_2$) can preferably have a value of about 30°. Of course, it should be understood that the values of the angles alpha, $alpha_1$, and $alpha_2$ are approximate and that variations of these angles would be within the scope of the present invention. In accordance with this particular embodiment, by locating the blast openings 9*a*, 9*b* at angles with respect to edges 7*a*, 7*b* of guide plate 7, the air pressure directed onto sheet 3 can preferably be maximized, thus an efficient use of this air pressure can be made in accordance with the present invention.

If the end of the sheet 3 is to be carried along to some extent, e.g. by the transfer drum 4, it will preferably be guided under the guide plate 7, essentially without any damage to the printed image. There can also preferably be blast openings 9 in the inlet area 14. In accordance with one embodiment of the present invention, the inlet opening 14 can be considered to be at the end of the guide plate 7 which lies closest to the transfer drum 4 (see FIGS. 1*c* and 2*a*). In accordance with an alternative embodiment of the present invention, it may be preferable that inlet area 14 not have any blast openings 9, preferably so that the sheet material 3 entering under guide plate 7 will be permitted to enter possibly more easily under guide plate 7, since the air from the blast openings 9 is preferably directed oppositely to the direction of travel A of the sheet material 3.

In accordance with one advantageous configuration of the present invention, the guide device 1, viewed over the length of the drum or of the cylinder 2, can preferably cover at least a portion of the shell surface 6. For this purpose, the guide device 1, viewed over the length of the drum or of the cylinder 2, can preferably be mounted so that it can be adjusted, and a multiplicity of such guide devices 1 can be fastened to the spindle 12, each preferably being individually adjustable with respect to the other guide devices 1.

Further, and in accordance with one embodiment, the guide device 1 can preferably be made to cover only a portion of surface 6 of cylinder 2, possibly to accommodate for various types and sizes of sheets 3 or paper stock. For example, if a small sheet size is used, only one guide device 1 may be needed. If a larger sheet size is used, several guide devices 1 preferably mounted side by side along spindle 12 may be used. Thus, the guide device 1 in accordance with the present invention can preferably be compatible with different sizes of sheets 3 or paper stock. In addition, it may be preferable to fasten several guide devices 1 next to one another along the length of the cylinder 2, possibly with some space between each of the guide devices 1. For example, one could possibly use three guide devices 1, two guide devices 1 being located near the ends of the cylinder 2, and one guide device 1 being located centrally between the first two end guide devices 1. This type of configuration of the guide devices 1 may be preferable when a thick paper stock 3 is used. The number of guide devices 1 needed for a particular printing run could be readily determined by one of ordinary skill in the art, depending on the type of paper stock 3 used.

In accordance with an alternative embodiment of the present invention, the guide plate 7 may extend across the entire length of the drum or cylinder 2, preferably so that the entire sheet 3 is covered, and therefore stabilized and guided, by the guide plate 7.

Figure 4:
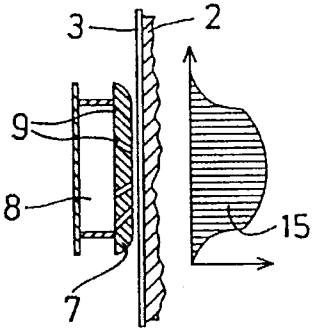
FIG. 4 shows a cross section through the guide device through line IV—IV of FIG. 2.
Figure 2:
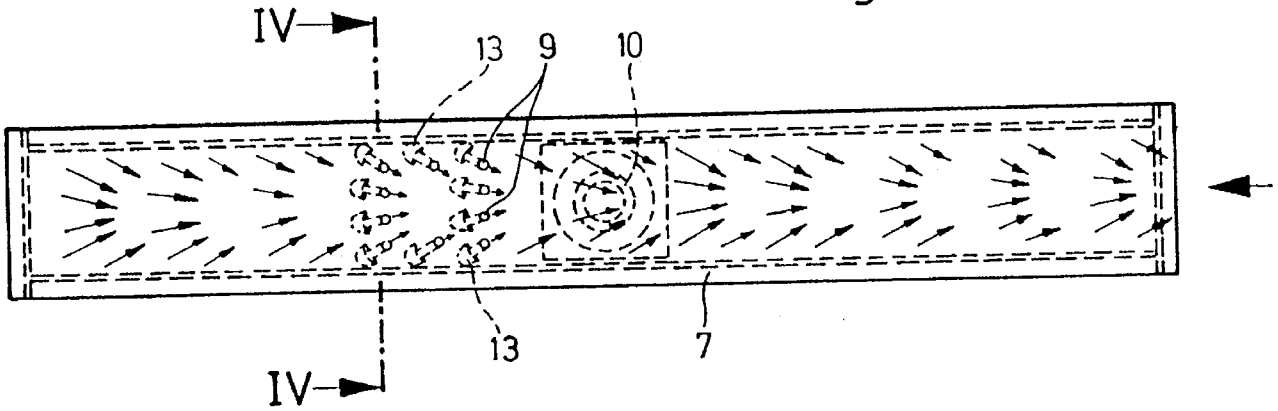
FIG. 2 shows a view in the direction of Arrow II in FIG. 1*b;*
Figure 4A:
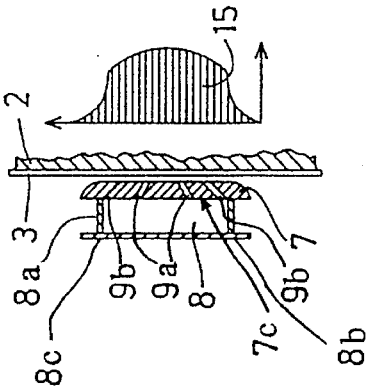
FIG. 4*a* shows substantially the same view as FIG. 4, but shows additional components.

FIGS. 4 and 4*a* show the distribution of pressure under the guide plate 7. This pressure distribution can preferably be represented by the diagram 15, which diagram 15 shows the curve of the pressure under the guide plate 7. In accordance with one embodiment, the view shown in FIGS. 4 and 4*a* can preferably be considered to be a cross-sectional view through the guide device 1 along line IV—IV in FIGS. 2 and 2*a*.

As can be seen in FIG. 4*a* and in accordance with one embodiment, the diagram 15 preferably illustrates that the pressure of the air in central openings 9*a* can be greater than the pressure in peripheral openings 9*b*, possibly due to fact that the central openings 9*a* are directed toward the center of the guide plate 7 and somewhat closer to the tube 10.

Figure 3:
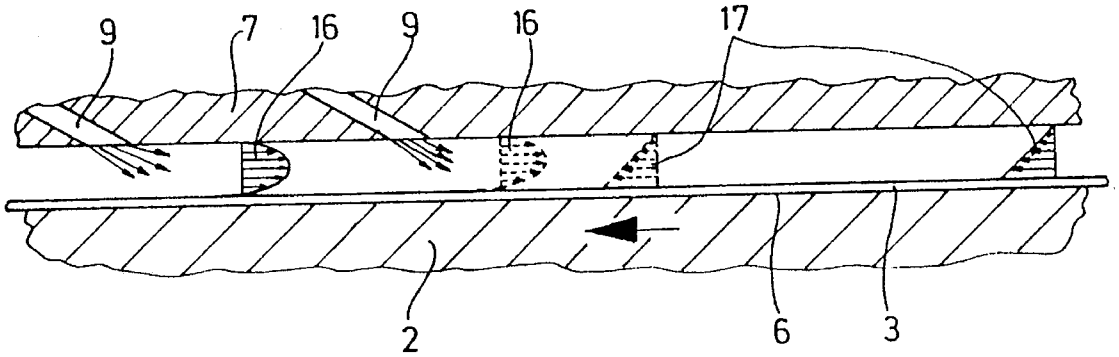
FIG. 3 shows a partial longitudinal section through the guide device and an air gap between the guide device and the cylinder.

FIG. 3 shows the reference numeral 16 which essentially represents the profile of the velocity of the air blown in between the guide plate 7 and the sheet material 3. FIG. 3 also shows the flow profile 17 of the moving boundary layer preferably on the surface of the sheet material 3.

Figure 3A:
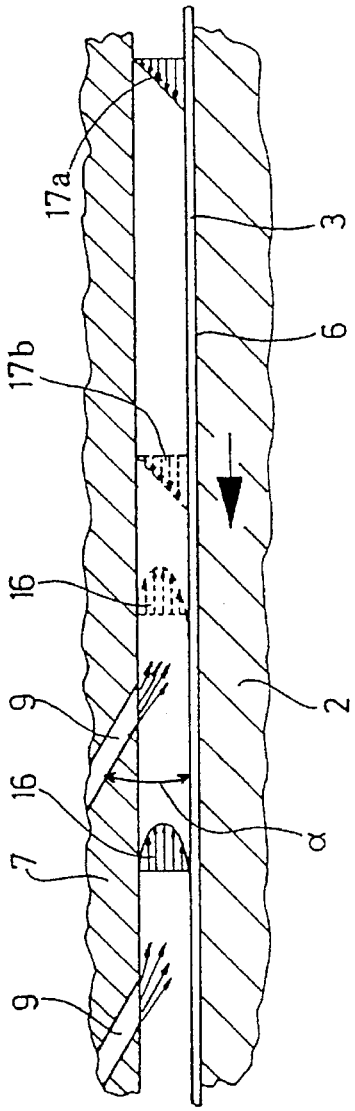
FIG. 3*a* shows substantially the same view as FIG. 3, but shows additional components.

In accordance with one embodiment of the present invention as shown in FIG. 3*a*, the flow profile 17*a* (shown in solid lines) can preferably be considered to represent the flow profile corresponding to a sheet 3, as the sheet 3 initially enters the guide plate 7. The flow profile 17*b* (shown in dotted lines) can be considered to represent the flow profile 17*a* corresponding to the sheet 3 at a later time, preferably as the sheet 3 approaches the openings 9. The flow profile 17*b* can preferably then be at least disrupted by the profile 16 of the openings 9, which can preferably contribute to the smoothing of the sheet 3 against surface 6.

Referring back to FIG. 1*c*, end in accordance with one embodiment of the present invention, the guide plate 7 can preferably essentially cover the open area on the printing cylinder 2 between the two adjacent cylinders, i.e. the area of the printing cylinder 2 which is located between the blanket cylinder 5 and the transfer drum 4. As can be seen in FIG. 1*c*, a relatively small amount of space can preferably be left between an end 8*e* of guide plate 7 and blanket cylinder 5, and between an end 8*d* (located near inlet 14) of guide plate 7 and transfer drum 4. The relatively small amount of space in these areas can preferably serve to keep the sheet 3 correctly positioned against surface 6 as the sheet 3 transfers from the transfer drum 4 to the printing cylinder 2, and, more importantly, as the sheet 3 approaches the blanket cylinder 5 to be printed. This positioning can preferably contribute to an improvement in the print quality on the sheet 3. Further, the trailing edge 3*a* of the sheet material 3 can preferably be maintained against the surface 6 of the printing cylinder 2, since the end 8*e* of guide plate 7 can be located relatively close to the blanket cylinder 5, end since there can preferably be openings 9 located adjacent end 8*d*, which openings 9 preferably direct a flow of air onto sheet 3 opposite to the direction of travel A of sheet 3. However, as stated above, it may be preferable that no openings 9 be located directly adjacent the end 8*d* of guide plate 7.

Further, in accordance with at least one embodiment of the present invention, contact between the sheet 3 and the guide device 1 can essentially be prevented due to the positioning of the openings 9 (opposite to the direction of travel A of the sheet 3), therefore, abrasions and tears in the sheet 3 can possibly be avoided. Still further, the contour of the guide plate 7 and the adjustable positioning of the guide plate 7, by means of the bracket 11 and spindle 12 as discussed above, can preferably serve to maintain an essentially constant gap width between the guide plate 7 and the sheet 3.

One feature of the invention resides broadly in the guide device for moving sheet material in printing presses, which by means of blown air presses the sheet material flat against the shell surface of a transporting drum or a cylinder, without any contact between the sheet material and the guide device, characterized by the fact that the guide device 1 has a guide plate 7 which matches or is adapted to the corresponding shell surface 6, that the guide plate 7 is connected to a blast chamber 8, and that the guide plate 7 has blast openings 9, which generate an air flow in the direction opposite to the direction of travel of the moving sheet material 3.

Another feature of the invention resides broadly in the guide device characterized by the fact that the blast openings 9 in the guide plate 7 are oriented diagonally, and are directed opposite to the direction of travel of the sheet material 3, to prevent the sheet material 3 from lifting up away from the surface 6 of the cylinder.

Yet another feature of the invention resides broadly in the guide device characterized by the fact that the blast openings 9 in the guide plate 7, in the peripheral area 13 of the guide plate 7 viewed in the direction at right angles to the direction of travel, are directed opposite to the direction of travel and inward, to prevent a lateral escape of the blown air.

Still another feature of the invention resides broadly in the guide device characterized by the fact that all the blast openings 9 in the guide plate 7 are directed opposite to the direction of travel and inward.

A further feature of the invention resides broadly in the guide device characterized by the fact that the guide device 1, viewed over the length of the drum or of the cylinder 2, covers a portion of the shell surface 6.

Another feature of the invention resides broadly in the guide device characterized by the fact that the guide device 1 is mounted so that it can be adjusted, viewed over the length of the drum or of the cylinder 2.

Types of arrangements for smoothing a sheets on a cylinder in a printing press may be disclosed in the following U.S. Pat. Nos. 5,156,190 to Wirz on Oct. 20, 1992, entitled "Device for Smoothing a Sheet on an Impression Cylinder of a Sheet-fed Rotary Printing Machine"; 2,764,408 to Weiler in September of 1956; 4,060,238 to Simeth in November of 1977; 4,395,949 to Jeschke in August of 1983; 3,506,259 to Caldwell et al. in April of 1970; 3,949,671 to Madigan in April of 1976; 3,986,455 to Jeschke in October of 1976; and 4,099,463 to Zimermann in July of 1978.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign patent publication applications, namely, Federal Republic of Germany Patent Application No. P 44 10 189.9, filed on Mar. 24, 1994, having inventor Günter Stephan, and DE-OS P 44 10 189.9 and DE-PS P 44 10 189.9, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. A printing press comprising:

a frame;

a plate cylinder rotatably mounted on said frame, said plate cylinder for accommodating a printing plate thereon;

an ink reservoir for holding a supply of ink;

an inking mechanism for transferring ink between said ink reservoir and said plate cylinder during operation of said printing press;

said inking mechanism comprising a plurality of inking rollers for transferring ink from said ink reservoir to said plate cylinder;

a blanket cylinder being rotatably mounted on said frame and having means for being engaged with said plate cylinder during operation of said printing press;

means for feeding sheets of printing stock into said printing press;

a cylinder for advancing sheets of printing stock, fed from said feeding means, towards said blanket cylinder to be printed, said cylinder having an axis of rotation and an outer circumferential surface disposed thereabout;

said outer circumferential surface of said cylinder having a contour;

said cylinder having a width dimension defined parallel to the axis of rotation;

means for guiding sheets of printing stock along said outer circumferential surface of said cylinder during rotation of said cylinder;

said guiding means comprising:

means for directing a flow of air, said means for directing a flow of air comprising the sole means for directing a flow of air on said cylinder;

said means for directing a flow of air comprising means for directing a flow of air towards said cylinder, to prevent the sheets of printing stock from being lifted off of said outer circumferential surface of said cylinder;

a guide plate, said guide plate comprising a guide surface;

said means for directing a flow of air towards said cylinder being disposed in said guide plate;

said guide surface having a width dimension and a length dimension, said guide surface being substantially contiguous and substantially unbroken along both said width dimension and said length dimension;

said guide plate having a thickness dimension, said thickness dimension being very substantially less than said length dimension of said guide surface, and very substantially less than said width dimension of said guide surface;

said guide surface being disposed adjacent said outer circumferential surface of said cylinder;

said width dimension and said length dimension of said guide surface both extending along a substantial portion of said outer circumferential surface of said cylinder, and along a substantial portion of said width dimension of said cylinder; and said guide surface having a contoured shape, said contoured shape substantially matching said contour of said outer circumferential surface of said cylinder.

2. The printing press according to claim 1 wherein:

said cylinder has a direction of rotation during printing, the sheets of printing stock having a direction of travel while moving along said outer circumferential surface of said cylinder, the direction of travel of the sheets of printing stock corresponding to said direction of rotation of said cylinder; and said means for directing a flow of air directs air towards said cylinder and the sheets of printing stock on said cylinder at an acute angle with respect to said outer circumferential surface of said cylinder, and in an opposite direction to the direction of travel of the sheets of printing stock and the direction of rotation of said cylinder during printing.

3. The printing press according to claim 2 wherein said means for directing a flow of air towards said cylinder comprises a plurality of orifices disposed in said guide plate.

4. The printing press according to claim 3 wherein:

said guide plate further comprises a first edge portion and a second edge portion disposed a substantial distance from one another;

said guide plate has a central axis disposed between said first edge portion and said second edge portion, the central axis being defined perpendicular to the axis of rotation of said cylinder;

said plurality of orifices are each disposed at an acute angle with respect to said outer circumferential surface of said cylinder; and at least some of said plurality of orifices are each disposed at a substantial angle with respect to the central axis of said guide plate.

5. The printing press according to claim 4 wherein said at least some of said plurality of orifices extend inwardly towards the central axis of said guide plate to substantially prevent a lateral escape of air.

6. The printing press according to claim 5 wherein:

said substantial angle is a first angle;

remaining ones of said plurality of orifices are each disposed at a second angle with respect to the central axis of said guide plate, said remaining ones of said plurality of orifices extending inwardly towards the central axis of said guide plate; and said second angle of said remaining ones of said plurality of orifices is smaller than said first angle.

7. The printing press according to claim 6 wherein:

said first edge portion and said second edge portion are disposed both parallel to one another and perpendicular with respect to the axis of rotation of said cylinder;

the central axis of said guide plate is defined parallel to both of said first edge portion and said second edge portion;

a portion of said at least some of said plurality of orifices are disposed immediately adjacent and along said first edge portion of said guide plate, and an additional portion of said at least some of said plurality of orifices are disposed immediately adjacent and along said second edge portion of said guide plate; and said remaining ones of said plurality of orifices are disposed immediately adjacent the central axis of said guide plate.

8. The printing press according to claim 7 wherein:

said guiding means further comprises a chamber for receiving pressurized air from a source of pressurized air, said chamber being in fluid communication with said plurality of orifices and being the sole chamber for providing pressurized air to said plurality of orifices;

said guide plate comprises an additional surface disposed opposite said guide surface, said additional surface facing away from said outer circumferential surface of said cylinder;

said chamber is disposed adjacent said additional surface; and said plurality of orifices extend between said guide surface and said additional surface.

9. The printing press according to claim 8 wherein said guiding means further comprises means for permitting said guide plate to be movably adjusted with respect to said outer circumferential surface of said cylinder, said means for permitting being disposed adjacent said chamber.

10. The printing press according to claim 9 wherein:

said guide plate further comprises:

a rear portion disposed parallel to said additional surface, said chamber being disposed between said additional surface and said rear portion;

third and fourth edge portions disposed parallel to one another and perpendicular to both of said first and second edge portions;

said first, second, third and fourth edge portions of said guide plate together define said guide surface;

said width dimension of said guide surface extends between said first edge portion of said guide plate and said second edge portion of said guide plate;

said length dimension of said guide surface extends between said third edge portion of said guide plate and said fourth edge portion of said guide plate;

said thickness dimension of said guide plate extends between said rear portion and said guide surface;

said plurality of orifices are distributed substantially uniformly across substantially the entire extent of said width dimension of said guide surface and substantially the entire extent of said length dimension of said guide surface;

said guiding means guides sheets of printing stock along said outer circumferential surface of said cylinder without any contact between said guiding means and the sheets of printing stock;

said guiding means further comprises a tube for transporting pressurized air from a source of pressurized air to said chamber; said means for permitting comprises:

a bracket for being attached to said frame of said printing press;

a spindle attached to said bracket;

a clamp attached to said spindle, said tube being attached to said clamp; and said clamp for permitting said guide plate to move with respect to said spindle; and said cylinder comprises one of: a printing cylinder and a sheet transfer cylinder.

11. A printing press comprising:

a frame;

a plate cylinder rotatably mounted on said frame, said plate cylinder for accommodating a printing plate thereon;

an ink reservoir for holding a supply of ink;

an inking mechanism for transferring ink between said ink reservoir and said plate cylinder during operation of said printing press;

said inking mechanism comprising a plurality of inking rollers for transferring ink from said ink reservoir to said plate cylinder;

a blanket cylinder being rotatably mounted on said frame and having means for being engaged with said plate cylinder during operation of said printing press;

means for feeding sheets of printing stock into said printing press;

cylinder means for advancing sheets of printing stock, fed from said feeding means, towards said blanket cylinder to be printed, said cylinder means having an axis of rotation and an outer circumferential surface disposed thereabout;

said outer circumferential surface of said cylinder means having a contour;

said cylinder means having a width dimension defined parallel to the axis of rotation;

means for guiding sheets of printing stock along said outer circumferential surface of said cylinder means during rotation of said cylinder means;

said guiding means comprising:

a guide surface;

said guide surface having a width dimension and a length dimension, said guide surface being substantially contiguous and substantially unbroken along both said width dimension and said length dimension;

said guide surface being disposed adjacent said outer circumferential surface of said cylinder means;

said width dimension and said length dimension of said guide surface both extending along a portion of said outer circumferential surface of said cylinder means and along a portion of said width dimension of said cylinder means;

means for receiving pressurized air from a source of pressurized air, said receiving means being disposed adjacent said guide surface;

said guide surface comprising:

means for directing a flow of air from said receiving means towards said outer circumferential surface of said cylinder means, to prevent the printing stock from being lifted off of said outer circumferential surface of said cylinder means, said means for directing a flow of air comprising a plurality of orifices disposed in said guide surface;

a contoured shape, said contoured shape substantially matching said contour of said outer circumferential surface of said cylinder means;

a first edge portion and a second edge portion disposed a distance from one another;

a central axis disposed between said first edge portion and said second edge portion, said central axis being defined perpendicular to the axis of rotation of said cylinder means;

at least one of said plurality of orifices having a longitudinal axis along which air flows, said longitudinal axis of said at least one orifice being disposed at a substantial angle with respect to the central axis of said guide surface;

said central axis of said guide surface lying in a radial plane of said cylinder means, the radial plane being disposed perpendicular to the axis of rotation of said cylinder means;

said substantial angle of said longitudinal axis being disposed to have an acute component angle with respect to the radial plane of said cylinder means;

said longitudinal axis of said at least one orifice extending inwardly towards said central axis of said guide surface to direct a flow of air inwardly towards said central axis of said guide surface, to substantially prevent a lateral escape of air from between said guide surface and said outer circumferential surface of said cylinder means; and said acute component angle being a substantial component angle.

12. The printing press according to claim 11 wherein:

said plurality of orifices each have a longitudinal axis along which air flows;

at least some of said longitudinal axes of corresponding ones of said plurality of orifices are each disposed at said substantial angle with respect to said central axis of said guide surface, said at least some of said longitudinal axes extending inwardly towards said central axis of said guide surface to direct a flow of air inwardly towards said central axis of said guide surface, to substantially prevent a lateral escape of air;

said substantial angle is a first angle;

said substantial component angle being a first acute component angle;

remaining ones of said longitudinal axes of corresponding ones of said plurality of orifices are each disposed at a second angle with respect to said central axis of said guide surface, said remaining ones of said longitudinal axes extending inwardly towards said central axis of said guide surface to direct a flow of air inwardly towards said central axis of said guide surface, to substantially prevent a lateral escape of air;

said second angle of each of said remaining ones of said longitudinal axes being disposed to have a second acute component angle with respect to the radial plane, said second acute component angle being a substantial angle; and said second acute component angle being smaller than said first acute component angle.

13. The printing press according to claim 12 wherein:

said cylinder means has a direction of rotation during printing, the sheets of printing stock having a direction of travel while moving along said outer circumferential surface of said cylinder means, the direction of travel of the sheets of printing stock corresponding to said direction of rotation of said cylinder means; and each of said plurality of orifices direct a flow of air towards said cylinder and the sheets of printing stock on said cylinder means in an opposite direction to the direction of travel of the sheets of printing stock and the direction of rotation of said cylinder means during printing.

14. The printing press according to claim 13 wherein:

said guiding means further comprises a guide plate, said guide plate comprising said guide surface; and said guide plate further comprises a thickness dimension, said thickness dimension being substantially less than said length dimension of said guide surface, and substantially less than said width dimension of said guide surface.

15. The printing press according to claim 14 wherein:

said first edge portion and said second edge portion are disposed both parallel to one another and perpendicular to the axis of rotation of said cylinder means;

said central axis of said guide surface is defined parallel to both of said first edge portion and said second edge portion;

a portion of said at least some of said plurality of orifices are disposed immediately adjacent and along said first edge portion of said guide surface, and an additional portion of said at least some of said plurality of orifices are disposed immediately adjacent and along said second edge portion of said guide surface; and said remaining ones of said plurality of orifices are disposed immediately adjacent said central axis of said guide surface.

16. The printing press according to claim 15 wherein:

said means for receiving comprises a chamber for receiving pressurized air from a source of pressurized air, said chamber being in fluid communication with said plurality of orifices and being the sole chamber for providing pressurized air to said plurality of orifices;

said guide plate comprises an additional surface disposed opposite said guide surface, said additional surface facing away from said outer circumferential surface of said cylinder means;

said chamber is disposed adjacent said additional surface; and said plurality of orifices extend between said guide surface and said additional surface.

17. The printing press according to claim 16 wherein said guiding means further comprises means for permitting said guide plate to be movably adjusted with respect to said outer circumferential surface of said cylinder means, said means for permitting being disposed adjacent said chamber.

18. The printing press according to claim 17 wherein:

said guide plate further comprises:

a rear portion disposed parallel to said additional surface, said chamber being disposed between said additional surface and said rear portion;

third and fourth edge portions disposed parallel to one another and perpendicular to both of said first and second edge portions;

said first, second, third and fourth edge portions of said guide plate together define said guide surface;

said width dimension of said guide surface extends between said first edge portion of said guide plate and said second edge portion of said guide plate;

said length dimension of said guide surface extends between said third edge portion of said guide plate and said fourth edge portion of said guide plate;

said thickness dimension of said guide plate extends between said rear portion and said guide surface;

said width dimension and said length dimension of said guide surface both extend along a substantial portion of said outer circumferential surface of said cylinder means and along a substantial portion of said width dimension of said cylinder means;

said plurality of orifices are distributed substantially uniformly across substantially the entire extent of said width dimension of said guide surface and substantially the entire extent of said length dimension of said guide surface;

said guiding means guides sheets of printing stock along said outer circumferential surface of said cylinder means without any contact between said guiding means and the sheets of printing stock;

said guiding means further comprises a tube for transporting pressurized air from a source of pressurized air to said chamber;

said means for permitting comprises:

a bracket for being attached to said frame of said printing press;

a spindle attached to said bracket;

a clasp attached to said spindle, said tube being attached to said clasp; and said clasp for permitting said guide plate to move with respect to said spindle; and said cylinder means comprises one of: a printing cylinder and a sheet transfer cylinder.

* * * * *

UNITED STATES PATENT AND TRADEMARK OFFICE

CERTIFICATE OF CORRECTION

PATENT NO. : 5,546,858

DATED : August 20, 1996

INVENTOR(S) : Günter STEPHAN

It is certified that error appears in the above-indentified patent and that said Letters Patent is hereby corrected as shown below:

In column 4, line 22, after 'D',', delete "end" and insert --and--.

In column 7, line 9, after '1c,', delete "end" and insert --and--.

In column 7, line 28, after '5,', delete "end" and insert --and--.

Signed and Sealed this

Seventeenth Day of December, 1996

*Attest:*

*Attesting Officer*

Bruce Lehman

BRUCE LEHMAN

*Commissioner of Patents and Trademarks*